US005350338A

United States Patent [19]

Hellman, Jr.

[11] Patent Number: 5,350,338

[45] Date of Patent: Sep. 27, 1994

[54] VAULT VENTILATOR SYSTEM

[76] Inventor: Robert R. Hellman, Jr., 3 McKinley St., Naugatuck, Conn. 06770

[21] Appl. No.: 31,632

[22] Filed: Mar. 15, 1993

Related U.S. Application Data

[60] Division of Ser. No. 732,735, Jul. 18, 1991, Pat. No. 5,194,039, which is a continuation of Ser. No. 597,209, Oct. 11, 1990, abandoned.

[51] Int. Cl.[5] ..... F24F 7/00

[52] U.S. Cl. ..... 454/195; 70/445; 109/1 V

[58] Field of Search ..... 70/301, 303, 310, 311, 70/332, 445; 109/1 V, 58.5, 27, 29, 59 T, 64; 454/195

[56] References Cited

U.S. PATENT DOCUMENTS

| | | | |
|---|---|---|---|
| 1,426,424 | 8/1922 | Taylor | 109/1 V |
| 1,539,242 | 5/1925 | Bezdecheck | 70/310 |
| 1,590,007 | 6/1926 | West | 109/1 V |
| 1,666,519 | 4/1928 | West . | |
| 1,666,673 | 4/1928 | Williams | 109/1 V |
| 1,786,277 | 12/1930 | West . | |
| 1,791,050 | 2/1931 | Williams . | |
| 1,800,237 | 4/1931 | Williams . | |
| 1,805,332 | 5/1931 | Goss . | |
| 1,810,184 | 6/1931 | McClintock et al. . | |
| 1,861,000 | 5/1932 | Ellithorpe . | |
| 1,873,452 | 8/1932 | Meilink | 70/445 |
| 4,224,861 | 9/1980 | Sands . | |

FOREIGN PATENT DOCUMENTS

| | | | |
|---|---|---|---|
| 585744 | 3/1925 | France | 70/310 |

*Primary Examiner*—Harold Joyce
*Attorney, Agent, or Firm*—John H. Crozier

[57] ABSTRACT

A system for introducing fresh air to a locked vault which is integral to the door of the vault. A fan provides motive force to the air which flows principally through passages in, or created with, existing components in the door. A food/water passage may be furnished by providing the door wheel spindle as a hollow, rather than a solid, tube.

3 Claims, 4 Drawing Sheets

VAULT VENTILATOR SYSTEM

CROSS-REFERENCE TO RELATED APPLICATIONS

This application is a division of U.S. application Ser. No. 07/732,735, filed Jul. 18, 1992, now U.S. Pat. No. 5,194,039, issued Mar. 16, 1993, which was a continuation of U.S. application Ser. No. 07/597,209, filed Oct. 11, 1990, abandoned.

BACKGROUND OF THE INVENTION

1. Field of the Invention

The present invention relates to vaults, or strong rooms generally and, more particularly, to a novel system for providing fresh air and/or food to a person or persons who may be trapped in such vaults, which system is integral with the vault door, which uses a number of components already existing in conventional locking means used in many vault doors.

2. Background Art

Some provision must be made in a vault installation for providing fresh air to a person or persons who may be trapped in a vault as a result of a burglary or even by accident. In most cases, once the door of such a vault has been closed and the locking mechanism activated, it cannot be opened again for some predetermined period of time. Also, there is usually no provision for opening such a door from the inside. Accordingly, provision must be made to provide fresh air, and, in some cases, food or liquid to person(s) trapped in a locked vault. Of course, the means for providing fresh air must be activatable by the person(s) within the vault, since their plight may not be discovered for some time.

Heretofore, attempts to address this problem have involved systems employing various types of tubes, sometimes with fresh air blowers, extending through the walls of vaults, which systems are activatable by various means by the person(s)inside the vaults. A substantial limitation of all such systems is that they are installed through the walls of the vaults, sometimes in the area of the door jambs, thus making retrofitting to existing vaults extremely difficult, since the walls and jambs are reinforced against forcible entry. In some cases, also, the walls or jambs must be thickened in the areas of the tubes passing therethrough to maintain the required security and/or fire rating of the vault, thereby increasing the difficulty of retrofitting to existing vaults and, in many cases, decreasing the volume of the vaults which would Otherwise be available for use and decreasing the flexibility of locating internal safety deposit boxes or other internal equipment. With many such known systems, the means to activate the system is cumbersome and difficult. All such known systems are relatively expensive.

Accordingly, it is a principal object of the present invention to provide a vault ventilator system which may be installed in the door of the vault.

It is an additional object of the invention to provide such a system that employs a number of components already used in vault doors.

It is a further object of the invention to provide such a system that can be easily retrofitted to existing vaults.

It is another object of the invention to provide such a system that is easily activatable and simply and economically manufactured.

An additional object of the invention is to provide such a system the installation of which does not require a decrease in the internal volume in the vault.

Other objects of the present invention, as well as particular features and advantages thereof, will be elucidated in, or be apparent from, the following description and the accompanying drawing figures.

SUMMARY OF THE INVENTION

The present invention achieves the above objects, among others, by providing, in a preferred embodiment, a system for introducing fresh air to a locked vault which is integral to the door of the vault. A fan provides motive force to the air which flows principally through passages in, or created with, existing components in the door. A food/water passage may be furnished by providing the door wheel spindle as a hollow, rather than a solid, tube.

BRIEF DESCRIPTION OF THE DRAWING

The invention will be better understood if reference is made to the accompanying drawing figures, in which.

DESCRIPTION OF THE PREFERRED EMBODIMENTS

Figure 1:
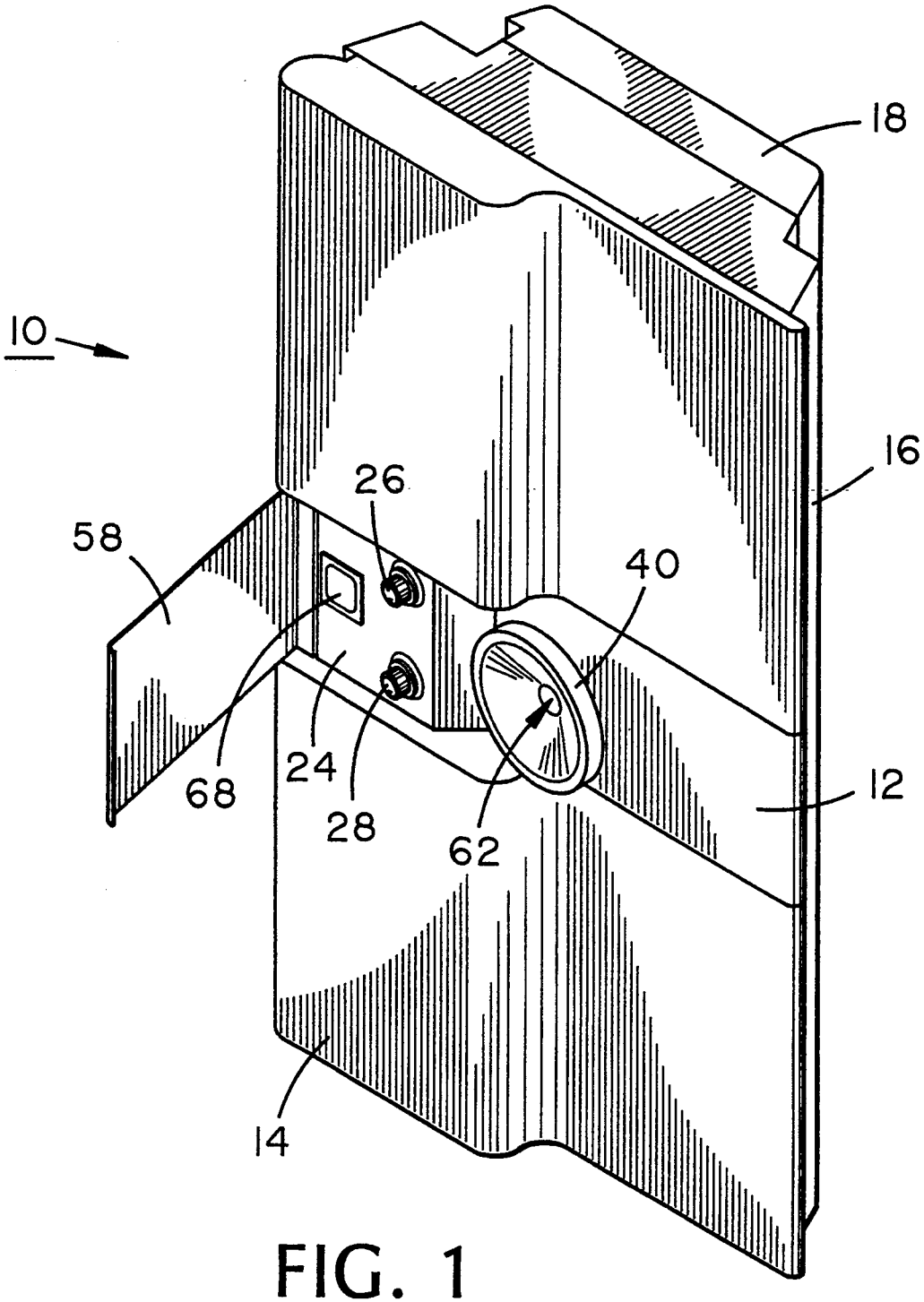
FIG. 1 is perspective view of a vault door employing the present invention.

Referring now to the Drawing, on which the same elements are given consistent identifying numerals throughout the various figures thereof, there is shown a vault door, generally indicated by the reference numeral 10, which door includes the elements of the present invention. For clarity, the locking/unlocking mechanisms incorporated in vault door 10 are not shown on the drawing figures and it will be understood that such mechanisms may be entirely conventional and that the details of any particularly type used will not affect the practicing of the present invention.

Figure 2:
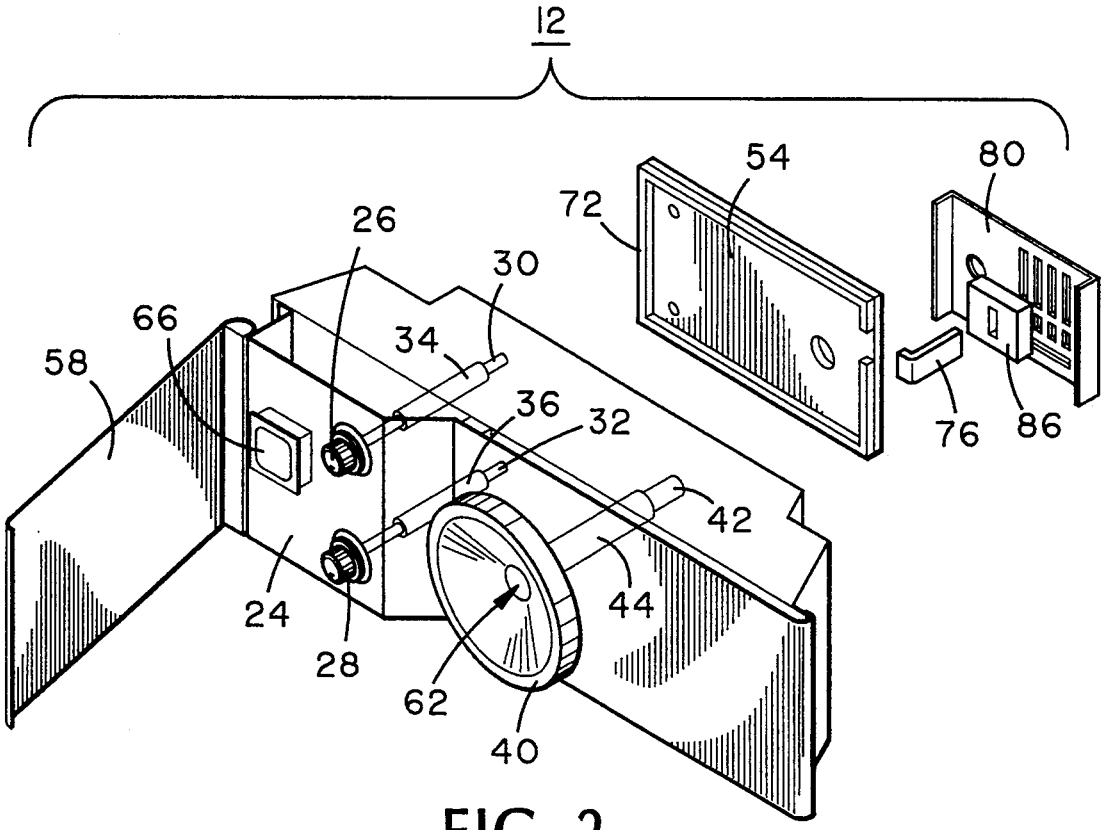
FIG. 2 is an exploded perspective view of the locking unit of the door of FIG. 1 showing the arrangement of the major elements of the present invention.
Figure 3:
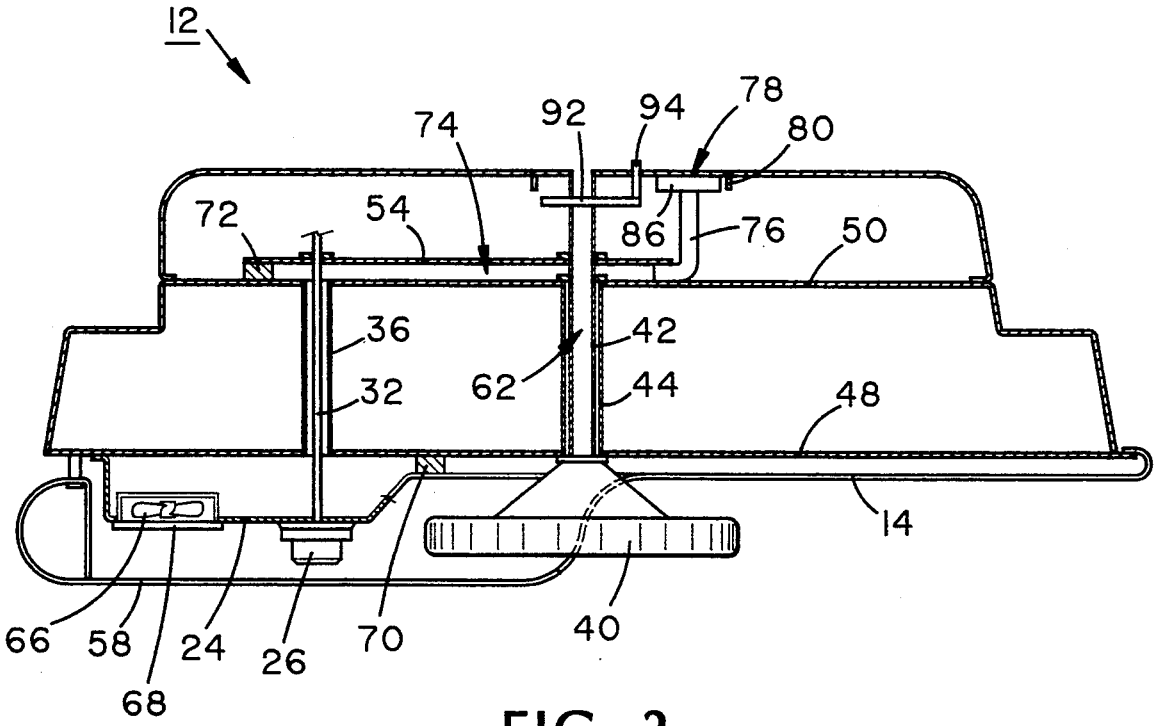
FIG. 3 is a cross-sectional view of the locking unit of FIG. 2.

With particular reference to FIGS. 1–3, door 10 includes a removable locking unit 12, a front panel 14, a rectangular frame 16, and a rear cover 18. Included in locking unit 12 is a center panel 24 on which are mounted lock combination dials 26 and 28 attached to lock spindles 30 and 32, respectively, which lock spindles are disposed in lock spindle tubes 34 and 36, respectively. Also mounted on center panel 24 is a door wheel 40 attached to door wheel spindle 42 which is disposed in door wheel spindle tube 44. Spindle tubes 34, 36, and 44 are welded between a front plate 48 and an intermediate plate 50. A tempered glass relock protection plate 54 extends over a portion of the rear surface of intermediate plate 50. A hinged cover 58 extends over the portion of center panel 24 containing lock combination dials 26 and 28.

So far, the elements described are entirely conventional. The conventional elements which have been revised, or new elements which have been added, for the present invention will now be described.

Still referring to FIGS. 1–3, door wheel spindle 42, rather than being solid as is the case with convention door wheel spindles, is hollow, thus forming a passageway 62 between the front of door 10 and the inside of the vault (not shown) on which the door is mounted. Passageway 62 may be used to pass food and/or water to the person(s) trapped inside the vault. In order to compensate for not having a solid door wheel spindle 42, tempered glass relock protection plate 54 has been extended around the area of the door wheel spindle.

To provide fresh air to the inside of the vault, a fan 66 is mounted inside center panel 24 to draw air through a fan grill 68 and force it through the existing clearances between lock spindles 30 and 32 and lock spindle tubes 34 and 36, respectively. To ensure that the air in fact passes through such clearances, a gasket 70 is provided between center panel 24 and front plate 48. To provide a further passage for the air once it arrives at the rear surface of intermediate plate 50, tempered glass relock protection plate 54 is raised slightly from the rear surface of the intermediate plate and sealed thereto by a gasket 72 so that the air may pass through a channel 74 defined between the rear surface of intermediate plate 50 and the inside surface of relock protection plate 54. From channel 74, the air passes through an air duct 76 and exits into the vault through a ventilator grill 78 formed in a control panel 80 (also FIG. 4).

Figure 4:
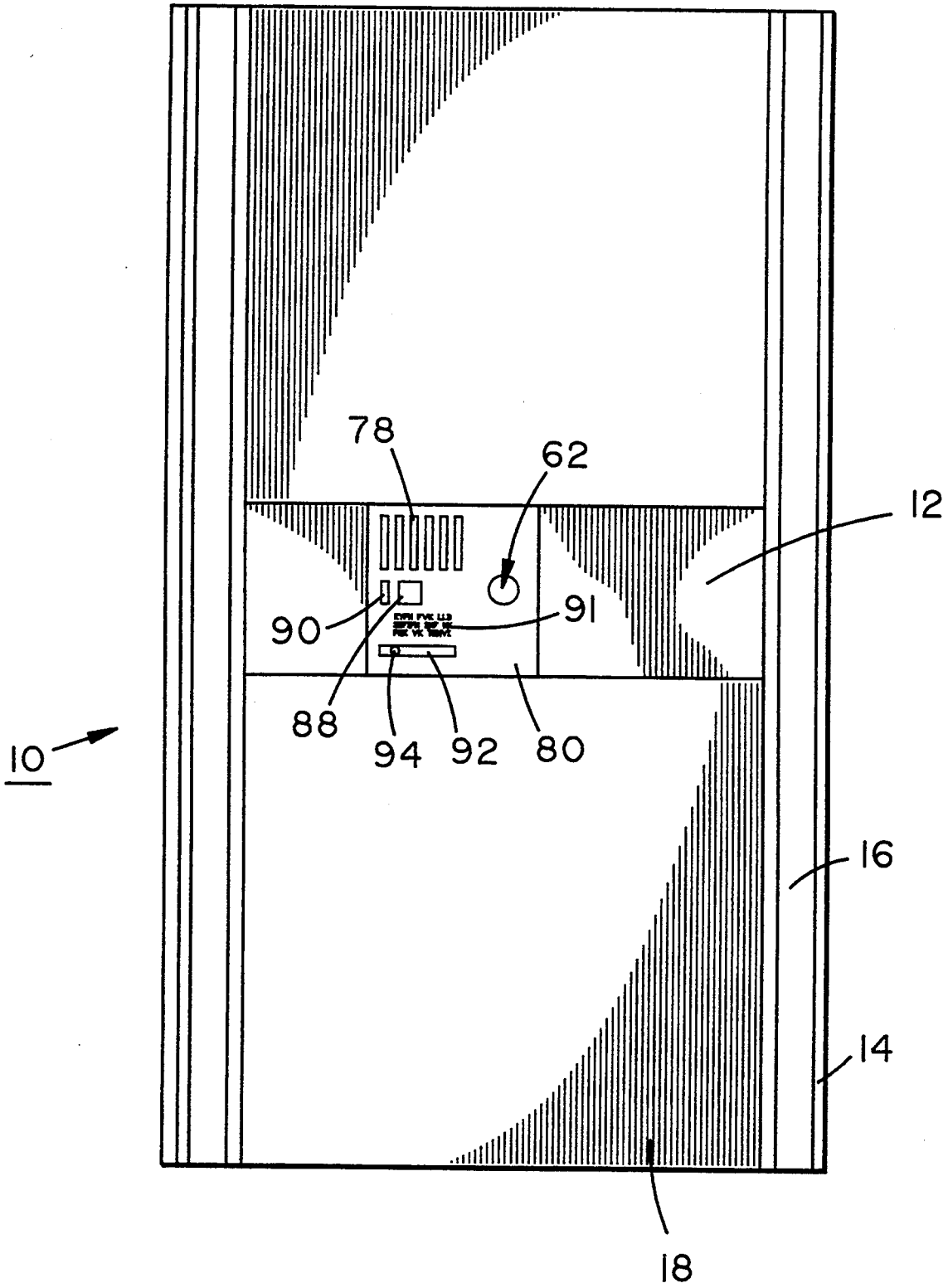
FIG. 4 is a rear elevation view of the door of FIG. 1.

Mounted behind control panel 80 is a housing 86 which encloses an on/off switch 88 (FIG. 4) and an on/off indicator light 90 (FIG. 4). The rear surface of control panel 80 may include instructions 91.

Figure 5:
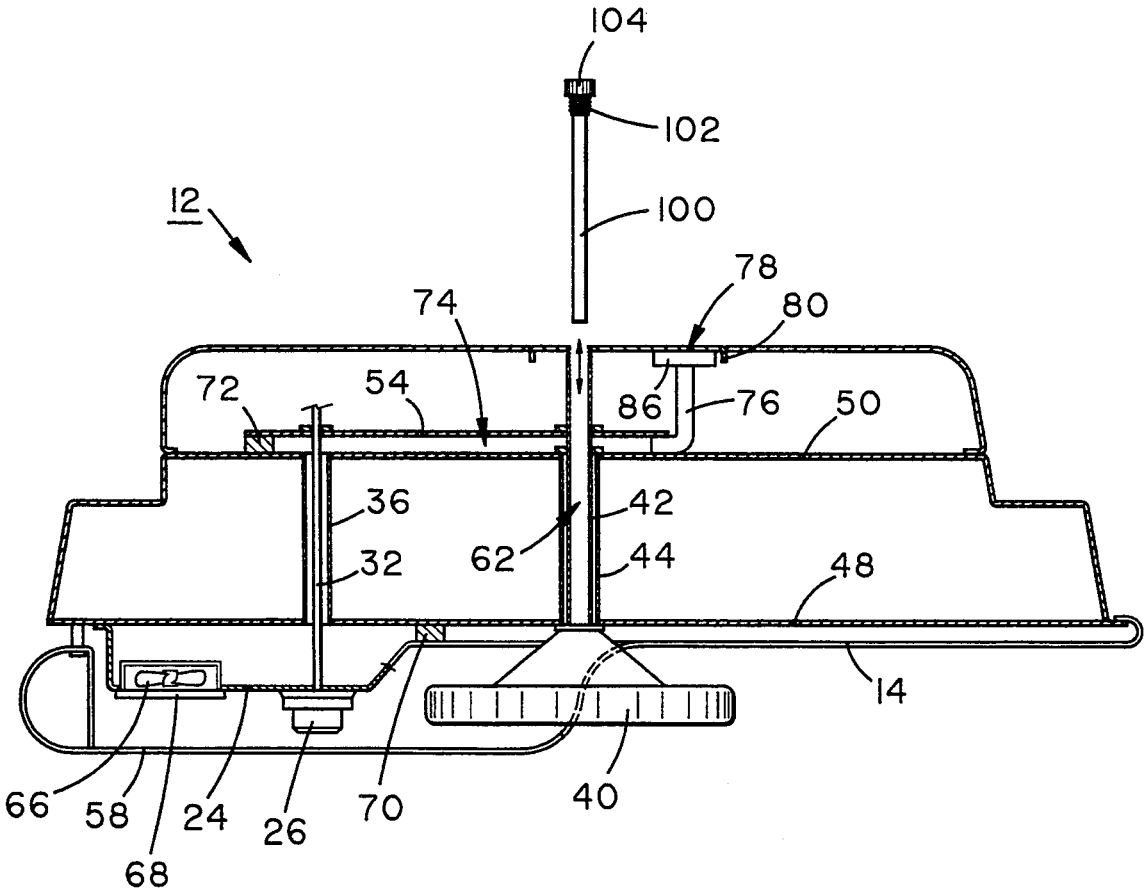
FIG. 5 is a cross-sectional view of the locking unit of FIG. 2 showing alternative means for sealing the food/-water passageway of the present invention.

Passageway 62 is opened by moving a slide 92 with an attached knob 94 from the position shown on FIG. 3 to the position shown on FIG. 4 to open the inner end of the passageway and, thus, provide communication between the interior of the vault and the front of door 10. In order to provide more secure closure of passageway 62, the embodiment of the present invention shown on FIG. 5 may be employed. Here, rather than effecting closure of only one end of passageway 62 with a slide, such as slide 92 on FIGS. 3 and 4, there is provided a solid tube 100 which can extend substantially throughout the passageway and which may be removably secured in place therein by advancing a threaded portion 102 into the inner end of the passageway. A knob 104 is provided at the inner end of tube 100 to aid in inserting and withdrawing the tube into and from passageway 62.

In use, once a person is locked in the vault, he locates control panel 80, preferably by means of a continuously lit small light (not shown) indicating the position of the control panel, and switches on the fan which action may also turn on emergency lights in the vault. If food, water, or other items are required, these may be obtained through passageway 62 after moving slide 94 to its open position or by removing tube 100 from the passageway. Otherwise, passageway 62 may be employed for the exiting of air, if necessary.

It will be understood that the teachings of the present invention could be applied so that stale air is positively removed from the vault by reversing the flow of air produced by fan 66, so that fresh air is drawn into the vault, for example, through passageway 62, and such is within the intent of the present invention.

It can be seen that the present invention may be employed without compromising the integrity of the vault walls or the vault door jamb.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A vault ventilator system to provide fresh air to the inside of a vault, comprising:

(a) means to cause said fresh air to flow into said vault; and (b) air passages defined between components of a lock mechanism installed in a door of said vault for the flow of air therethrough, wherein said air passages include a first clearance defined between at least one lock spindle and a lock spindle tube within which said at least one lock spindle is disposed.

2. A vault ventilator system, as defined in claim 1, wherein said air passages include a second clearance defined between a relock protection plate and an intermediate plate, said second clearance created by spacing said relock protection plate apart from said intermediate plate in sealed relationship by means of a gasket disposed therebetween.

3. A vault ventilator system, as defined in claim 2, further comprising an air duct disposed for air communication between said second clearance and the inside of said vault.

* * * * *